United States Patent [19]

Dougherty

[11] Patent Number: 5,018,495

[45] Date of Patent: May 28, 1991

[54] AUTOMATIC IDLE SPEED CIRCUITRY

[75] Inventor: Michael Dougherty, Detroit, Mich.

[73] Assignee: Colt Industries, Inc., New York, N.Y.

[21] Appl. No.: 233,025

[22] Filed: Aug. 17, 1988

[51] Int. Cl.[5] ..... F02M 3/00

[52] U.S. Cl. ..... 123/339

[58] Field of Search ..... 123/339, 585, 308; 251/129

[56] References Cited

U.S. PATENT DOCUMENTS

| | | | |
|---|---|---|---|
| 4,630,581 | 12/1986 | Shibata | 123/339 |
| 4,662,334 | 5/1987 | Wietschorke et al. | 123/339 |
| 4,702,209 | 10/1987 | Sausner et al. | 123/339 |
| 4,708,110 | 11/1987 | Wietschorke et al. | 123/339 |
| 4,771,750 | 9/1988 | Breitkrautz et al. | 123/339 |
| 4,796,580 | 1/1989 | Wakeman | 123/339 |

*Primary Examiner*—Raymond A. Nelli
*Attorney, Agent, or Firm*—Howard S. Reiter

[57] ABSTRACT

A throttle body includes a secondary passageway having an inlet communicating with a central passageway upstream of a throttle plate disposed in the central passageway. An outlet communicates with an intake manifold of the engine downstream of the throttle plate to allow fluid flow to bypass the throttle plate. A pocket is formed in the throttle body and a seat is formed at the bottom of the pocket to communicate with the secondary passageway. A motor is disposed within the pocket and secured to the throttle body and cooperates with the seat for metering predetermined amounts of fluid flow past the seat. An opening is formed intersecting with the pocket and the outlet to form an internal flow path within the throttle body to allow fluid flow past the seat to flow through the outlet and bypass the throttle plate when in the closed position.

2 Claims, 1 Drawing Sheet

AUTOMATIC IDLE SPEED CIRCUITRY

BACKGROUND OF THE INVENTION

1. Field of the Invention

The present invention relates to automotive vehicles, more particularly to, fluid flow through a throttle body on an engine for automotive vehicles.

2. Description of Related Art

Currently, a throttle body on an engine has a throttle plate for controlling the amount of air that flows to the cylinders of the engine. During engine operation, the amount of air desired to perform idle speed conditions is typically controlled electronically. The path of the air must travel from above the throttle plate, bypassing the throttle plate via a drilling from inside the throttle body, to an orifice that meters the air by means of an electronically controlled stepper motor. The air metered from the orifice is finally dumped below the throttle plate to be mixed within fuel downstream.

One problem with the above circuitry is that a separate casting is used to house the stepper motor, resulting in extra machining and parts to secure the stepper motor to the throttle body. Another problem is that the path for idle speed air is interrupted by externally machined communication drillings and plugs.

It is, therefore, an object of the present invention to provide an automatic idle speed circuitry which eliminates the us of unnecessary drillings and external plugs to complete the circuitry. It is another object of the present invention to provide a path for idle speed air that is uninterrupted by externally machined communication drillings and plugs. It is still another object of the present invention to provide a low cost automatic idle speed circuitry.

SUMMARY OF THE INVENTION

Accordingly, the present invention is an automatic idle speed circuitry for allowing fluid flow to an intake manifold of an engine including a throttle body having a longitudinal axis with means forming a central passageway along the axis. A throttle plate means is disposed transversely to the longitudinal axis for rotation between an open and closed position to allow fluid flow to the intake manifold of the engine. The throttle body includes means forming a secondary passageway having an inlet communicating with the central passageway upstream of the throttle plate means and an outlet to communicate with the intake manifold downstream of the throttle plate means to allow fluid flow to bypass the throttle plate means when in the closed position. A means forms a pocket in the throttle body and a seat at the bottom of the pocket communicating with the secondary passageway. A motor means is disposed within the pocket and secured to the throttle body and cooperates with the seat for metering predetermined amounts of fluid flow past the seat. A means forms an opening intersecting with the pocket and the outlet to form an internal flow path within the throttle body to allow fluid flow past the seat to flow through the outlet and bypass the throttle plate means when in the closed position.

One advantage of the present invention is that the idle speed air path is totally internal and uninterrupted by externally machined communication drillings and plugs. Another advantage of the present invention is that the idle speed circuitry eliminates the need for a separate casting to house the stepper motor and unnecessary drillings and external plugs to complete the circuitry. A further advantage of the present invention is a low cost idle speed circuitry due to the use of two simple drillings as opposed to external drillings and plugs.

BRIEF DESCRIPTION OF THE DRAWINGS

Other advantages of the present invention will be readily appreciated as the same becomes better understood by reference to the following detailed description when considered in connection with the accompanying drawings wherein.

DESCRIPTION OF THE PREFERRED EMBODIMENT

Figure 1:
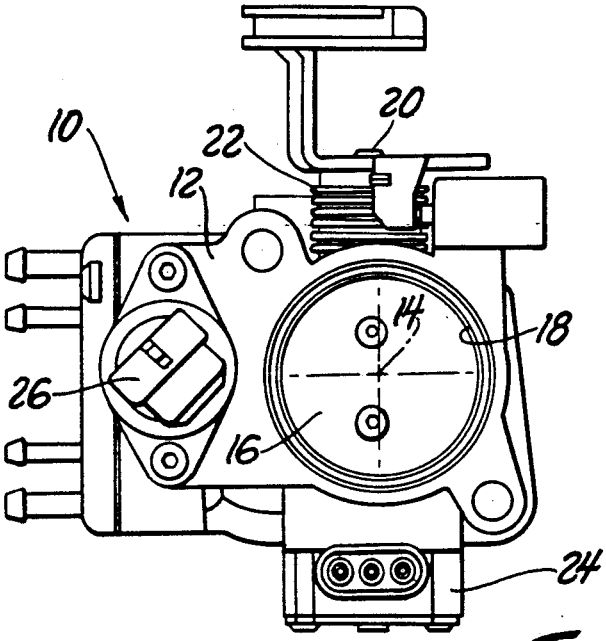
FIG. 1 is a plan view of an automatic idle speed circuitry according to the present invention.

Referring to FIG. 1, an automatic idle speed circuitry according to the present invention is generally shown at 10. The circuitry 10 includes a throttle body 12 having a generally cylindrical shape with a longitudinal axis 14. The throttle body 12 is mounted upon the engine (not shown) in a known manner. The throttle body 12 includes a throttle plate 16 disposed transversely to the longitudinal axis 14 within a central or primary passageway 18 formed along the longitudinal axis 14 by the throttle body 12. The throttle plate 16 is supported by a shaft 20 for pivotal movement about the axis of the shaft 20 between an open and closed or idle position to allow fluid flow through the central passageway 18. A biasing means 22 is disposed at one end of the shaft 20 to bias the throttle plate 16 in the closed or idle position as commonly known in the art. A throttle plate sensing means 24 is disposed at the other end of the shaft 20 for sensing the position of the throttle plate 16 as is commonly known in the art. The sensing means 24 relays this information to an on-board computer or electronic control unit (ECU) (not shown).

Figure 2:
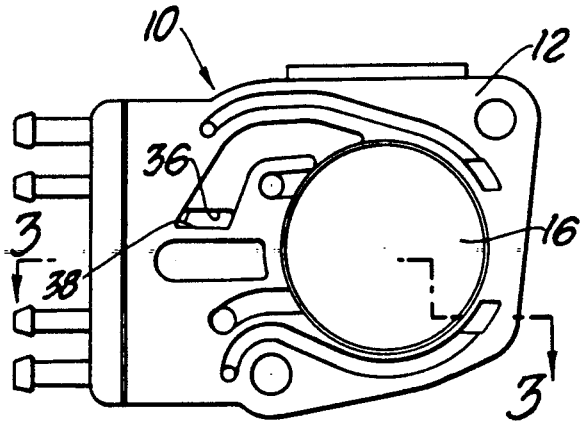
FIG. 2 is a bottom view of the structure shown in FIG. 1.
Figure 3:
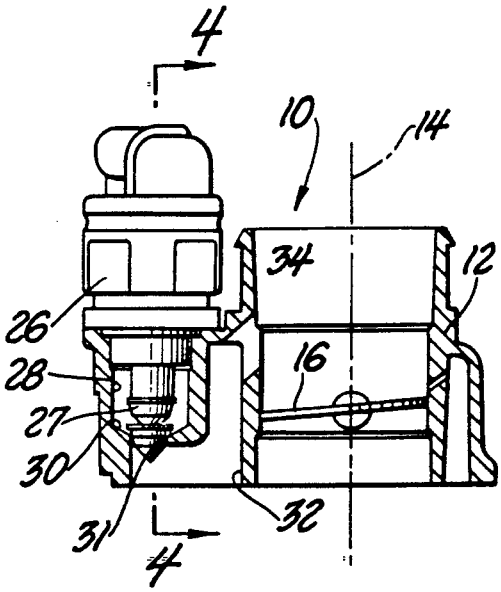
FIG. 3 is a sectional view of FIG. 2 taken along line 3—3 thereof.

Referring to FIG. 3, a linear drive or stepper motor 26 has a pintel valve 27 and is disposed in a bore or pocket 28 formed in the throttle body 12. The pocket 28 is drilled or machined in the throttle body 12 and has a seat 30 about an orifice 31 at the bottom of the pocket 28. The steppe motor 26 is secured to the throttle body 12 by means such as fasteners. The throttle body 12 includes means forming a secondary passageway or idle speed fluid path 32 in the throttle body 12. The fluid path 32 has an inlet 34 communicating with the central passageway 18 upstream of the throttle plate 16. As illustrated in FIG. 2, the throttle body 12 also includes means forming an outlet 36 communicating with the intake manifold (not shown) of the engine downstream of the throttle plate 16. The fluid path 28 and outlet 36 are separated by a dividing wall 37. The stepper motor 26 is controlled by the ECU. The pintel valve 27 of the stepper motor 26 is rotated and moved axially to open and close the seat 30 to meter predetermined amounts of fluid flow in a known manner from the inlet 34 of the fluid path 28 past the seat 30.

Figure 4:
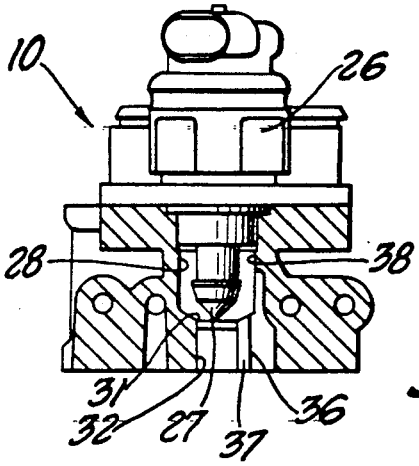
FIG. 4 is a sectional view of FIG. 3 taken along line 4—4 thereof.

Referring to FIG. 4, the pocket 28 includes an intersecting aperture or opening 38 formed in the dividing wall 37 of the throttle body 12 between the pocket 28 and the outlet 36. By drilling vertically to size the bore or pocket 28 which contains the stepper motor 26 and pintel valve 27, the opening 38 is created by removing a portion of the dividing wall 37 to complete a totally internal passageway from the inlet 34, through fluid path 32, past seat 30, through pocket 28 and opening 38 and outlet 36 to the intake manifold. Hence, the present invention provides a totally internal idle fluid or air path which is automatically obtained by two simple drillings as opposed to external drillings and plugs, or cast housings mounted with screws to accomplish the same circuitry.

The present invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, the present invention may be practiced otherwise than as specifically described.

What is claimed is:

1. Automatic idle speed fluid circuitry for controlling fluid flow to an intake manifold of an engine, said circuitry comprising:

a throttle body having a longitudinal axis and including means forming a central passageway along said axis;

throttle plate means disposed within said central passageway transversely to said axis for rotation between an open and closed position to allow fluid flow through said central passageway to the intake manifold on the engine;

said throttle body including means forming a secondary passageway having an inlet communicating with said central passageway upstream of said throttle plate;

said throttle body further including means forming an outlet communicating with the intake manifold downstream of said throttle plate means;

means integral with said throttle body forming a pocket in said throttle body and a seat at the bottom of said pocket communicating with said secondary passageway;

motor means disposed within said pocket and secured to said throttle body and cooperating with said seat for metering predetermined amounts of fluid flow past said seat;

means forming an opening intersecting with said pocket and said outlet to form an internal fluid flow path within said throttle body to allow fluid flow past said seat to flow through said outlet and to bypass said throttle plate means when in said closed position;

said inlet and said secondary passageway and said pocket and said opening and said outlet together form a continuous fluid flow path; and said motor means comprises a stepper motor having a drive shaft and a pintel valve at one end of said drive shaft which moves axially to open and close said seat.

2. The invention as set forth in claim 1 wherein said means for forming an opening comprises a wall between said secondary passageway and said outlet.

* * * * *